US009121287B2

(12) United States Patent
Weisse et al.

(10) Patent No.: US 9,121,287 B2
(45) Date of Patent: Sep. 1, 2015

(54) HOLLOW FAN BLADE WITH HONEYCOMB FILLER

(75) Inventors: Michael A. Weisse, Tolland, CT (US); Kwan Hui, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 483 days.

(21) Appl. No.: 13/611,541

(22) Filed: Sep. 12, 2012

(65) Prior Publication Data

US 2014/0072427 A1 Mar. 13, 2014

(51) Int. Cl.

| | |
|---|---|
| ***F01D 5/18*** | (2006.01) |
| ***F01D 5/14*** | (2006.01) |
| ***F04D 29/38*** | (2006.01) |
| *F01D 21/04* | (2006.01) |

(52) U.S. Cl.

CPC ..... *F01D 5/147* (2013.01); *F04D 29/388* (2013.01); *F01D 21/045* (2013.01); *F05D 2220/36* (2013.01); *F05D 2240/306* (2013.01); *F05D 2250/283* (2013.01)

(58) Field of Classification Search

CPC ..... F01D 5/147; F04D 29/324; F04D 29/338; F05D 2240/301; F05D 2240/305; F05D 29/388

USPC ..... 416/229 R, 232

See application file for complete search history.

(56) References Cited

U.S. PATENT DOCUMENTS

| | | | | |
|---|---|---|---|---|
| 5,725,355 | A | 3/1998 | Crall et al. | |
| 7,189,064 | B2 | 3/2007 | Helder et al. | |
| 7,284,960 | B2 | 10/2007 | Aynsley | |
| 7,993,105 | B2 | 8/2011 | Weisse et al. | |
| 8,075,273 | B2 | 12/2011 | Aynsley | |
| 8,075,274 | B2 | 12/2011 | Carvalho | |
| 8,251,664 | B2 * | 8/2012 | Schreiber | 416/191 |
| 2008/0253885 | A1 * | 10/2008 | Foose et al. | 415/208.2 |
| 2010/0209235 | A1 * | 8/2010 | Shim et al. | 415/200 |
| 2011/0211965 | A1 | 9/2011 | Deal et al. | |
| 2012/0171018 | A1 | 7/2012 | Hasel et al. | |
| 2012/0291449 | A1 * | 11/2012 | Adams et al. | 60/793 |

FOREIGN PATENT DOCUMENTS

| | | | |
|---|---|---|---|
| EP | 0877167 | A1 | 11/1998 |
| EP | 2362066 | A2 | 8/2011 |

OTHER PUBLICATIONS

International Search Report and Written Opinion for International Application No. PCT/US2013/058409 completed on Dec. 6, 2013.

International Preliminary Report on Patentability for International Application No. PCT/US2013/058409 mailed Mar. 26, 2015.

* cited by examiner

*Primary Examiner* — Ninh H Nguyen

(74) *Attorney, Agent, or Firm* — Carlson, Gaskey & Olds

(57) ABSTRACT

A fan blade has an airfoil main body extending between a leading edge and a trailing edge. The airfoil also has suction and pressure sides. A cavity is formed into said main body, and receives a filler material. A cover closes off the cavity, and is attached to the main body, with the cover having a thickness defined in a direction perpendicular to the suction side. The main body has a spar which extends along the cavity, with a thickness of the spar at a central location between ends of the cavity which has a second thickness. A ratio of the first thickness to the second thickness is between 0.5 and 2. A fan rotor and a gas turbine engine are also disclosed.

20 Claims, 2 Drawing Sheets

144
$d_4$
$d_2$
127
135
$d_3$
131
130
151
128
301
129
300
140

120
118
124
116

122
120
2
118
121
2
124

122
142
128
135
301
144
$d_1$
151
140
300
130
120
121
200

HOLLOW FAN BLADE WITH HONEYCOMB FILLER

BACKGROUND OF THE INVENTION

This application relates to a hollow fan blade for a gas turbine engine.

Gas turbine engines may be provided with a fan for delivering air to a compressor section. The fan also delivers bypass air into a bypass duct. From the compressor section, the air is compressed and delivered into a combustion section. The combustion section mixes fuel with the air and combusts the combination. Products of the combustion pass downstream over turbine rotors which are driven to rotate and in turn rotate the compressor and fan.

The fan may include a rotor having a plurality of blades.

One type of fan blade is a hollow fan blade having an internal cavity defined forwardly of a spar, which defines one side of the fan blade. Some filler material, such as a honeycomb filler, is received within the cavity, and a cover is placed over the honeycomb material, closing off the cavity. In the prior art, the cover was not structural, and was made to be much thinner than the thickness of the spar wall. In one example, the cover was one-sixth the thickness of the spar wall. Thus, the spar wall provided all structural integrity for the central areas of the fan blade. The blades are subject to a number of challenges, including internal stresses that vary along the length of the fan blade.

Recently, fans have been provided with a gear drive from a turbine. This has enabled a dramatic increase in the fan's diameter. With this enlarged fan blade, there are much greater structural challenges along the fan blade. In addition, the larger fan blade is more likely to be impacted by debris, or by bird strikes.

SUMMARY

In a featured embodiment, a fan blade has a main body having an airfoil extending between a leading edge and a trailing edge, and a suction side and a pressure side. A cavity is formed into the main body, and receives a filler material. A cover closes off the cavity, and attaches to the main body. The cover has a first thickness defined in a direction perpendicular to the suction side. The main body has a spar extending along the cavity, with a thickness of the spar at a central location between ends of the cavity having a second thickness, and a ratio of the first thickness to the second thickness is between 0.5 and 2.

In another embodiment according to the previous embodiment, the ratio of the first thickness to the second thickness is between 0.80 and 1.10.

In another embodiment according to any of the previous embodiments, the filler material is a honeycomb material.

In another embodiment according to any of the previous embodiments, the cover includes at least an inner cover and an outer cover. The first thickness is the combination of a thickness of the outer and inner covers.

In another embodiment according to any of the previous embodiments, a third thickness of the fan blade includes the first and second thicknesses. A thickness of the honeycomb layer at the central location is defined. A ratio of the first thickness to the third thickness is between 0.02 and 0.4.

In another embodiment according to any of the previous embodiments, the thickness of the spar is measured at a radially central location in addition to the central location between the ends of said cavity In another featured embodiment, a fan section has a rotor with a plurality of fan blades. The fan blades have a main body with an airfoil extending between a leading edge and a trailing edge, and a suction side and a pressure side. A cavity is formed into the main body, and receives a filler material. A cover closes off the cavity, and is attached to the main body. The cover has a first thickness defined in a direction perpendicular to the suction side. The main body has a spar extending along the cavity. A thickness of the spar at a central location between ends of the cavity has a second thickness. A ratio of the first thickness to the second thickness is between 0.5 and 2.

In another embodiment according to any of the previous embodiments, the ratio of the first thickness to the second thickness is between 0.80 and 1.10.

In another embodiment according to any of the previous embodiments, the filler material is a honeycomb material.

In another embodiment according to any of the previous embodiments, the cover includes at least an inner cover and an outer cover. The first thickness is the combination of a thickness of the outer and inner covers.

In another embodiment according to any of the previous embodiments, the thickness of the spar is measured at a radially central location in addition to the central location between the ends of the cavity.

In another embodiment according to any of the previous embodiments, a third thickness of the fan blade includes the first and second thicknesses. A thickness of the honeycomb layer at the central location is defined. A ratio of the first thickness to the third thickness is between 0.02 and 0.4.

In another featured embodiment a gas turbine engine has a fan section, a compressor section, and a turbine section. The fan section includes a rotor with a plurality of fan blades. The fan blades have a main body with an airfoil extending between a leading edge and a trailing edge, and a suction side and a pressure side. A main body extends between a leading edge and a trailing edge. A cavity is formed into the main body. The cavity receives a filler material. A cover closes off the cavity, and is attached to the main body. The cover has a first thickness defined in a direction perpendicular to the suction side. The main body has a spar extending along said cavity. A thickness of the spar at a central location between ends of the cavity have a second thickness. A ratio of the first thickness to the second thickness is between 0.5 and 2.

In another embodiment according to any of the previous embodiments, the ratio of the first thickness to the second thickness is between 0.80 and 1.10.

In another embodiment according to any of the previous embodiments, the filler material is a honeycomb material.

In another embodiment according to any of the previous embodiments, the cover includes at least an inner cover and an outer cover. The first thickness is the combination of a thickness of the outer and inner covers.

In another embodiment according to any of the previous embodiments, a third thickness of the fan blade includes the first and second thicknesses. A thickness of the honeycomb layer at the central location is defined. A ratio of the first thickness to the third thickness is between 0.02 and 0.4.

In another embodiment according to any of the previous embodiments, a turbine in the turbine section drives the rotor through a gear reduction.

In another embodiment according to any of the previous embodiments, the fan section delivers a portion of air into a bypass duct, and a portion of air into the compressor section. A ratio of the bypass air volume to the air delivered into the compressor section is greater than six.

The thickness of the spar is measured at a radially central location in addition to the central location between the ends of the cavity.

These and other features of the invention will be better understood from the following specification and drawings, the following of which is a brief description.

DETAILED DESCRIPTION

Figure 1A:
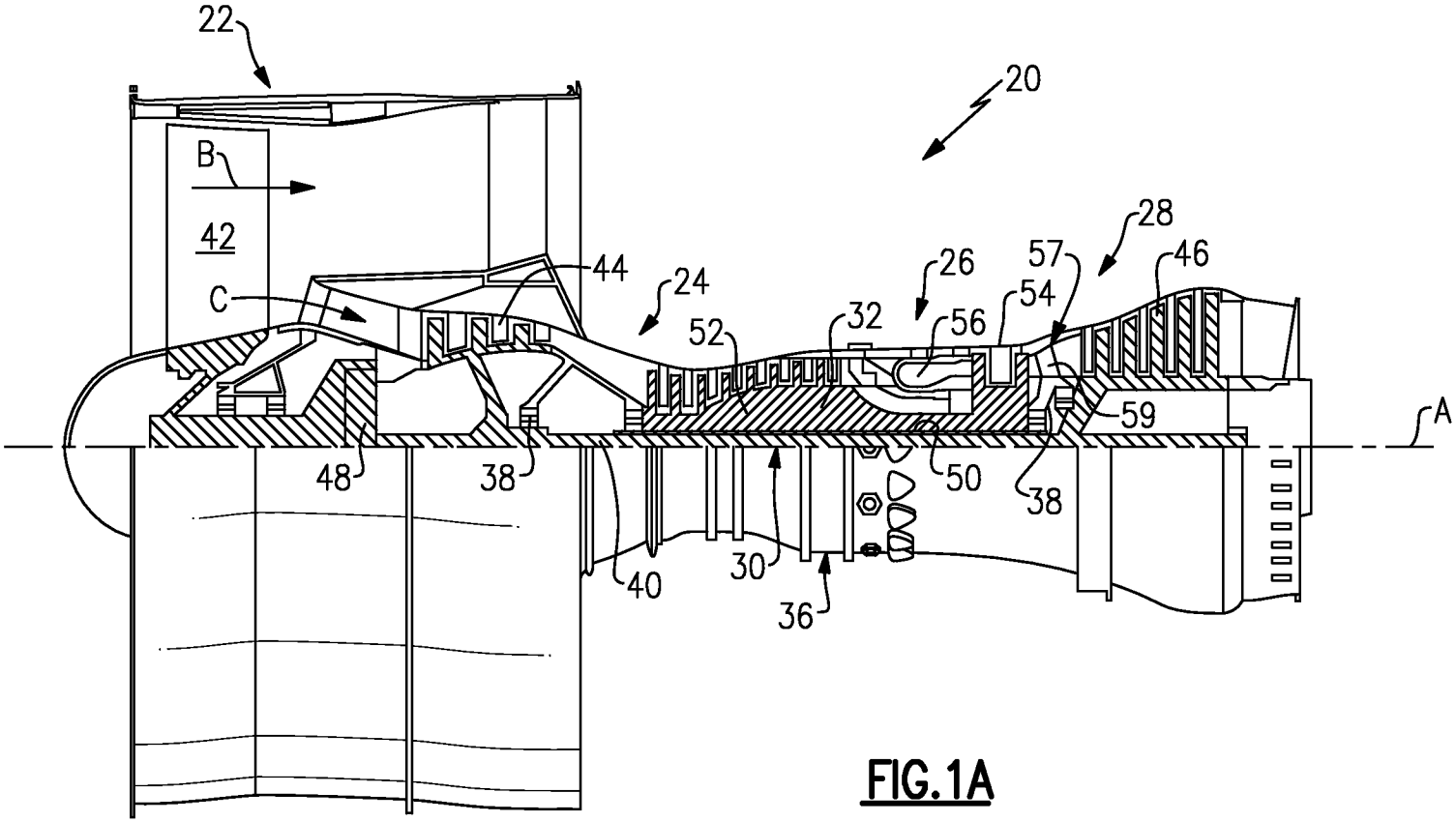
FIG. 1A shows a gas turbine engine.

FIG. 1A schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath B while the compressor section 24 drives air along a core flowpath C for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a planetary gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [((Tambient deg R)/518.7)^0.5]. The "Low corrected fan tip speed" as disclosed herein according to one non-limiting embodiment is less than about 1150 ft/second (–351 meter/second).

Figures 1B, 1C, 2, 3:
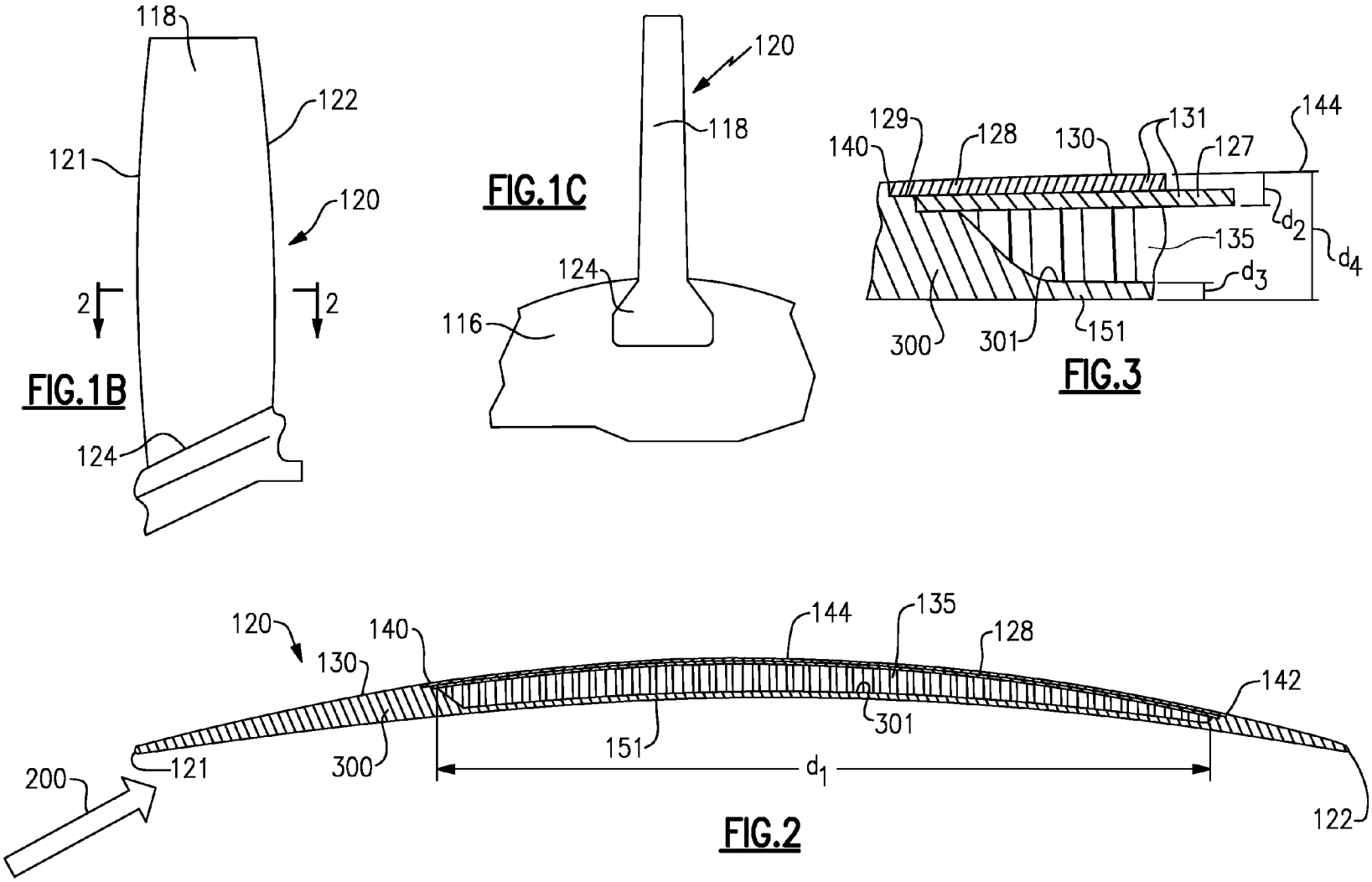
FIG. 1B shows an embodiment of a fan blade.
FIG. 1C shows another feature of the FIG. 1A fan blade.
FIG. 2 is a cross-sectional view along line 2-2 as shown in FIG. 1A.
FIG. 3 shows the geometric details of the fan blade.

A fan blade 120 that may be incorporated into fan 42 is illustrated in FIG. 1B having an airfoil 118 extending radially outwardly from a dovetail 124. A leading edge 121 and a trailing edge 122 define the forward and rear limits of the airfoil 118.

As shown in FIG. 1C, a fan rotor 116 receives the dovetail 124 to mount the fan blade with the airfoil 18 extending radially outwardly. As the rotor is driven to rotate, it carries the fan 120 blade with it.

The fan blade 120 is illustrated in FIGS. 2 and 3, and having a main body extending between the leading edge 121 and the trailing edge 122. As shown, a suction side 130 of the blade 120 receives a first cover 131 that includes cover 128 received in a ditch 129 in the fan blade. In this embodiment, a second cover 127 is positioned inward of the first cover 128, and also in a portion of the ditch 129. Second cover 127 is part of the cover 131. Of course, the cover 128 could include three or more separate cover portions also.

Honeycomb filler material 135 sits in a cavity 301 between the cover 128 (or 127) and an opposed spar 151. Spar 151 is part of an integral fan blade body 300 along with edges 121 and 122, and extends beyond ends 140 and 142 of the cavity 301 in the fan blade 120. An axial distance of the cavity 301 is defined between ends 140 and 142 and parallel to an axial dimension defined between edges 121 and 122. Although honeycomb filler material is disclosed, other types of filler may be used.

As shown in FIG. 3, the cover 131 has a thickness $d_2$, and the spar has a thickness $d_3$. The total thickness of the fan blade is $d_4$ at a location 144. Location 144 is generally a central location which is centered between ends 140 and 142 of the cavity. The spar thickness will vary and the $d_3$ is also measured at location 144. The $d_3$ and $d_4$ thicknesses are also measured at a radially central location across a radial span of the blade 120. That is, a center point between the radially outermost end of the airfoil 118 and the radially inner end of the platform 124. This might be approximately the location of the section 2-2 as shown in FIG. 1B. The thicknesses are perpendicular to the suction side 130.

In one embodiment, $d_2$ was 0.060 inch (1524 μm) and $d_3$ was also 0.060 inch (1524 μm). In this embodiment $d_1$ was 18 inch (45.7 cm) and $d_4$ was 0.33 inch (0.8 cm).

By making $d_2$ closer in thickness to $d_3$, $d_2$ provides structural integrity. Notably, the dimension $d_2$ would include the outer cover 128 and the inner covers 127 should one be utilized. That is, $d_2$ is the combination of the thickness of all cover materials combined.

An impact 200 is shown in FIG. 2 adjacent the leading edge 121. The cover 128 along with the spar 151, and the honeycomb material 135 provide an I-beam construction which is more likely to resist the impact adjacent central areas of the blade 120. In the prior art where the cover was very thin when compared to the spar, this impact might have caused more damage.

In embodiments, the ratio of $d_2$ to $d_3$ is between 0.5 and 2. More narrowly, in embodiments the ratio would be between 0.80 and 1.10.

A ratio of $d_2$ to $d_4$ is between 0.02 and 0.4.

Embodiments of this invention have been disclosed, however, a worker of ordinary skill in this art would recognize that certain modifications would come within the scope of this invention. For that reason, the following claims should be studied to determine the true scope and content of this invention.

The invention claimed is:

1. A fan blade comprising:

a main body having an airfoil extending between a leading edge and a trailing edge, and a suction side and a pressure side, and a cavity formed into said main body, said cavity receiving a filler material; and a cover closing off said cavity and on said suction side, and attached to said main body, with said cover having a first thickness defined in a direction perpendicular to the suction side, and said main body having a spar extending along said cavity, with a thickness of said spar at a central location between ends of said cavity having a second thickness, and a ratio of said first thickness to said second thickness being between 0.5 and 2.

2. The fan blade as set forth in claim 1, wherein the ratio of said first thickness to said second thickness is between 0.80 and 1.10.

3. The fan blade as set forth in claim 1, wherein said filler material is a honeycomb material.

4. The fan blade as set forth in claim 1, wherein said cover includes at least an inner cover and an outer cover, and said first thickness is the combination of a thickness of said outer and inner covers.

5. The fan blade as set forth in claim 1, wherein a third thickness of said fan blade including said first and second thicknesses and a thickness of said honeycomb layer at said central location is defined, and a ratio of said first thickness to said third thickness is between 0.02 and 0.4.

6. The fan blade as set forth in claim 1, wherein said thickness of said spar is measured at a radially central location in addition to said central location between said ends of said cavity.

7. A fan section comprising:

a rotor with a plurality of fan blades, with said fan blades having a main body having an airfoil extending between a leading edge and a trailing edge, and a suction side and a pressure side, and a cavity formed into said main body, said cavity receiving a filler material, a cover closing off said cavity and on said suction side, and attached to said main body, with said cover having a first thickness defined in a direction perpendicular to the suction side, and said main body having a spar extending along said cavity, with a thickness of said spar at a central location between ends of said cavity having a second thickness, and a ratio of said first thickness to said second thickness being between 0.5 and 2.

8. The fan section as set forth in claim 7, wherein the ratio of said first thickness to said second thickness is between 0.80 and 1.10.

9. The fan section as set forth in claim 7, wherein said filler material is a honeycomb material.

10. The fan section as set forth in claim 7, wherein said cover includes at least an inner cover and an outer cover, and said first thickness is the combination of a thickness of said outer and inner covers.

11. The fan section as set forth in claim 7, wherein a third thickness of said fan blade including said first and second thicknesses and a thickness of said honeycomb layer at said central location is defined, and a ratio of said first thickness to said third thickness is between 0.02 and 0.4.

12. The fan section as set forth in claim 7, wherein said thickness of said spar is measured at a radially central location in addition to said central location between said ends of said cavity.

13. A gas turbine engine comprising:

a fan section, a compressor section, and a turbine section;

said fan section including a rotor with a plurality of fan blades, with said fan blades having a main body having an airfoil extending between a leading edge and a trailing edge, and a suction side and a pressure side, and a main body extending between a leading edge and a trailing edge, and a cavity formed into said main body, said cavity receiving a filler material, a cover closing off said cavity and on said suction side, and attached to said main body, with said cover having a first thickness defined in a direction perpendicular to the suction side, and said main body having a spar extending along said cavity, with a thickness of said spar at a central location between ends of said cavity having a second thickness, and a ratio of said first thickness to said second thickness being between 0.5 and 2.

14. The gas turbine engine as set forth in claim 13, wherein the ratio of said first thickness to said second thickness is between 0.80 and 1.10.

15. The gas turbine engine as set forth in claim 13, wherein said filler material is a honeycomb material.

16. The gas turbine engine as set forth in claim 13, wherein said cover includes at least an inner cover and an outer cover, and said first thickness is the combination of a thickness of said outer and inner covers.

17. The gas turbine engine as set forth in claim 13, wherein a third thickness of said fan blade including said first and second thicknesses and a thickness of said honeycomb layer at said central location is defined, and a ratio of said first thickness to said third thickness is between 0.02 and 0.4.

18. The gas turbine engine as set forth in claim 13, wherein a turbine in said turbine section drives said rotor through a gear reduction.

19. The gas turbine engine as set forth in claim 13, wherein the fan section delivers a portion of air into a bypass duct, and a portion of air into the compressor section, and a ratio of the bypass air volume to the air delivered into the compressor section is greater than six.

20. The gas turbine engine as set forth in claim 13, wherein said thickness of said spar is measured at a radially central location in addition to said central location between said ends of said cavity.

* * * * *